US007568916B1

(12) United States Patent
Stuhmer

(10) Patent No.: US 7,568,916 B1
(45) Date of Patent: Aug. 4, 2009

(54) DRAWING APPARATUS AND METHOD

(75) Inventor: Wilco R. Stuhmer, 615 E. Greenwood Ave., Midvale, UT (US) 84047

(73) Assignee: Wilco R. Stuhmer, Midvale, UT (US)

( * ) Notice: Subject to any disclaimer, the term of this patent is extended or adjusted under 35 U.S.C. 154(b) by 593 days.

(21) Appl. No.: 11/222,931

(22) Filed: Sep. 8, 2005

Related U.S. Application Data

(60) Provisional application No. 60/608,749, filed on Sep. 9, 2004.

(51) Int. Cl.
*B43L 1/12* (2006.01)

(52) U.S. Cl. ..... 434/410

(58) Field of Classification Search ..... 434/81, 434/85, 88, 98, 409, 410
See application file for complete search history.

(56) References Cited

U.S. PATENT DOCUMENTS 3,279,100 A * 10/1966 Knott ..... 434/410
3,497,970 A * 3/1970 Padowicz ..... 434/410
3,647,279 A 3/1972 Sharpless et al.
3,863,386 A * 2/1975 Kinberg ..... 446/183
4,395,835 A 8/1983 Schneider
4,507,087 A 3/1985 Stevenson
4,600,393 A * 7/1986 Rosenwinkel et al. ..... 434/88
4,631,847 A 12/1986 Colin
4,801,266 A 1/1989 Kinberg
5,284,445 A * 2/1994 Dietterich et al. ..... 434/419
5,324,202 A * 6/1994 Meyers et al. ..... 434/410
5,425,664 A * 6/1995 Coffey ..... 446/135
5,676,549 A 10/1997 Arad et al.
5,775,914 A 7/1998 Smith
5,904,976 A 5/1999 Berry et al.
6,481,127 B1 11/2002 Bilbie et al.
6,722,891 B1 * 4/2004 Ma ..... 434/409
6,805,559 B2 * 10/2004 Mak ..... 434/410

* cited by examiner

*Primary Examiner*—Kurt Fernstrom
(74) *Attorney, Agent, or Firm*—Kirton & McConkie; William T. Ralston

(57) ABSTRACT

A drawing apparatus includes a rigid base surface, a flexible drawing surface, and a viscous, sticky medium disposed between the rigid base surface and the flexible drawing surface. Drawings can be formed by applying localized pressure, for example using a finger, fingernail, or stylus, to the flexible drawing surface thereby displacing a portion of the medium to place the drawing surface in near and persistent contact with the rigid base surface. Various color combinations for the medium, rigid base surface, and flexible drawing surface can be used.

19 Claims, 5 Drawing Sheets

DRAWING APPARATUS AND METHOD

CROSS-REFERENCE TO RELATED APPLICATIONS AND CLAIM OF PRIORITY

This application claims the benefit of U.S. Provisional Patent Application Ser. No. 60/608,749, filed Sep. 9, 2004, entitled "Finger Drawing Apparatus and Method" which is hereby incorporated by reference in its entirety for all purposes.

BACKGROUND OF THE INVENTION

1. Field of the Invention

The present invention relates generally to drawing. More particularly, the present invention relates to a drawing apparatus and method.

2. Related Art

Various techniques for drawing are known. Drawing has traditionally been performed by applying a paint or ink to a surface. Drawings can be produced using paints and a paintbrush, but paints are easily spilled and paintbrushes must be cleaned after use. Drawings can also be produced on paper through the use of pens, pencils, felt tip markers, and the like. Pens and markers, however, can dry out and become useless. The need for paper can also sometimes prove tedious, and waste paper can accumulate.

Reusable drawing systems, such as chalkboards and marker boards are popular for use in classroom instruction or as message boards. Chalkboards, however, tend to be messy and dusty. Marker boards require the use of markers which can dry out and become useless. Marker boards can also be easily damaged by using improper markers.

Some reusable drawing systems are known, such as the Etch A Sketch® toy and so-called "Magic Slate" devices. Although a fun toy, the Etch A Sketch toy is too difficult to use for some applications. For example, young children can find it difficult to simultaneously manipulate and coordinate the two knobs to create a drawing. Magic Slate devices, for example, as described by U.S. Pat. No. 6,481,127 to Bilbie, address some of these difficulties, but have other problems. For example, drawing or writing on a magic slate device requires the use of a stylus, which can be lost or misplaced. Known reusable drawing devices also tend to provide limited colors and contrast.

SUMMARY OF THE INVENTION

It has been recognized that it would be advantageous to develop drawing apparatus suitable for use in drawing using a finger, fingernail, or stylus.

In one embodiment, the invention includes a drawing apparatus that includes a base having a rigid base surface. Attached to the base is a flexible drawing surface so as to form a thin chamber between the rigid base surface and the flexible drawing surface. Disposed within the thin chamber is a viscous, sticky medium. The viscous, sticky medium retains a substantially uniform thickness independent of the apparatus orientation. An image can be drawn by applying localized pressure to the drawing surface so as to displace a portion of the medium to place the drawing surface in near and persistent contact with the rigid base. Either the base or the flexible drawing surface (or both) is transparent, so that the image is viewable.

Additional features and advantages of the invention will be apparent from the detailed description which follows, taken in conjunction with the accompanying drawings, which together illustrate, by way of example, features of the invention.

DETAILED DESCRIPTION

Figure 1:
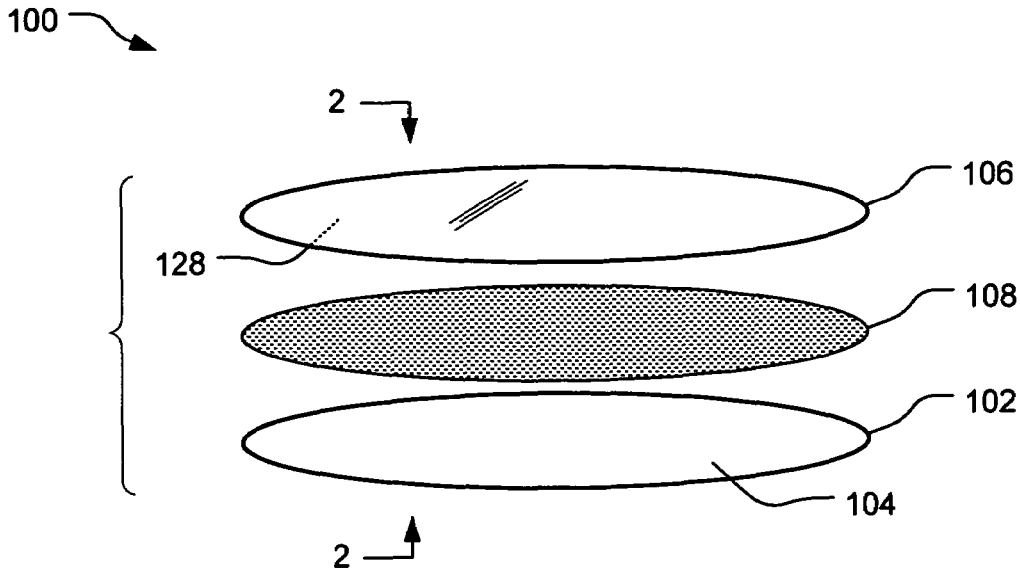
FIG. 1 is an exploded perspective view of a drawing apparatus in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
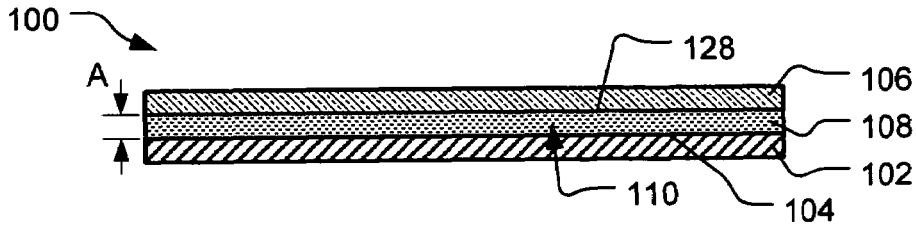
FIG. 2 is a cross-sectional view of the drawing apparatus of FIG. 1.
Figure 3:
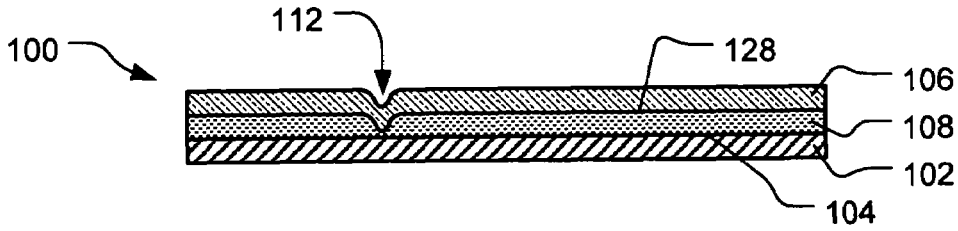
FIG. 3 is a cross-section view of the drawing apparatus of FIG. 1 showing a drawing line.

A drawing apparatus 100 is illustrated in FIG. 1, and in cross section view in FIGS. 2 and 3 in accordance with an embodiment of the present invention. The drawing apparatus includes a base 102 which has a rigid surface 104. Attached to the base is a flexible drawing surface 106. Between the base and flexible drawing surface is a viscous, sticky medium 108. The base and flexible drawing surface are joined together to form a chamber 110 in which the viscous, sticky medium is contained. The viscous, sticky medium 108 maintains a substantially uniform thickness independent of the drawing apparatus 100 orientation due to both its viscosity and stickiness. For example, in one embodiment, the thickness is approximately 0.040 inch (1 mm). In particular, the stickiness tends to cause the medium to adhere to the rigid base surface 104 and to adhere to the inner surface 128 of the drawing surface 106. In other words, the medium provides a nonpermanent lamination between the rigid base surface and drawing surface. The viscosity tends to cause the medium to remain in a particular position relative to the rigid base surface and the flexible drawing surface. The thickness of the viscous, sticky medium need not be exactly uniform as drawing with the apparatus involves creating some thinner areas in the medium as will now be described.

Figure 4:
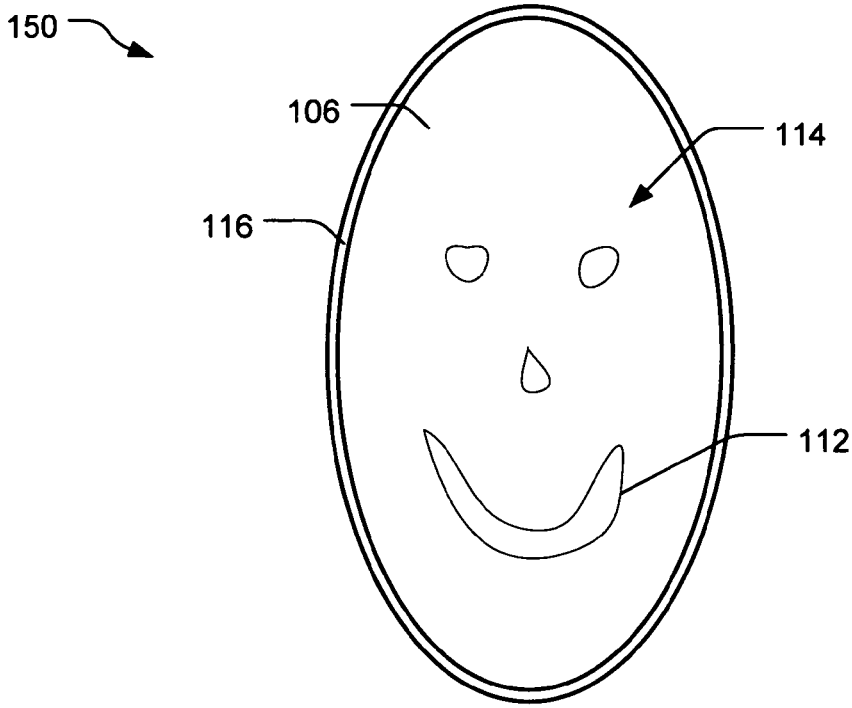
FIG. 4 is a top view of a drawing apparatus having a drawing in accordance with another embodiment of the present invention.

Drawing is performed by applying localized pressure to the flexible drawing surface 106 with a drawing implement, for example, a finger, fingernail, or stylus. By applying localized pressure to the drawing surface, a portion of the viscous, sticky medium 108 is displaced, placing a localized area 112 (FIG. 3) of the flexible drawing surface in near contact with the rigid base surface 104. The rigidity of the base helps to ensure that the medium is displaced and adhesion to the drawing surface to the base takes place. Hence, the base need only be rigid enough to provide this drawing ability. Due to the combined viscosity and stickiness of the medium, the displaced medium and localized area of the flexible drawing surface will tend to persist in their displaced positions. Lines and curves can be drawn by drawing the drawing implement across the drawing surface while continuing to apply localized pressure. A drawing can thus be formed in the drawing apparatus 100 by drawing a series of lines or curves. For example, FIG. 4 illustrates a drawing apparatus 150 having a drawing 114 image formed from a series of drawing lines 112. Where the drawing lines have been formed, the viscous, sticky medium is displaced, resulting in a thinner region.

Depending on the color and light-transmitting characteristics of the flexible drawing surface, medium, and base, contrast and color differences are provided between areas where drawing lines have been formed and other areas. Although the transparent drawing surface 106 (FIG. 1) is shown as transparent, this is not essential. Either the flexible drawing surface or the base 104, or both, can be transparent. For example, with a transparent drawing surface, drawing and viewing is performed from the same side. With a transparent base, viewing is from the base side, and drawing is performed on the opposite, drawing surface side. If both the base and drawing surface are transparent, viewing can be performed from either side. Various options for color and light-transmitting characteristics of the materials are discussed in further detail below.

Optionally, the ease of drawing can be enhanced by applying a lubricant to the drawing surface. For example, lubricant may be placed on the eraser so that the lubricant is replenished each time the drawing is erased. Various suitable lubricants will occur to one of skill in the art, including for example silicon or non-toxic soap solutions.

A variety of different materials can be used for the viscous, sticky medium. For example, a material having a binder and pigment, such as paint, can be used. Depending upon the viscosity and stickiness of the medium, different performance of the drawing apparatus is obtained. For example, a high viscosity medium allows long image persistence and a high stickiness medium provides clear drawing lines. At the other extreme, a low viscosity medium allows short image persistence and a low stickiness medium provides soft edges to drawing features (e.g., a cloudy effect). An excessively viscous medium may prove difficult to manipulate by hand. Conversely, an insufficiently viscous medium may not provide a substantially uniform thickness as the medium tends to pool at one end of the chamber. Sharper, more distinct image edges can be formed in a medium having a higher stickiness and viscosity using a more localized drawing force (e.g. a stylus). The binder in the medium can be adjusted to provide for more or less stickiness and/or viscosity.

As a more specific example, the medium can be washable paint, e.g. Rich Art® Color Company Washable Paint. This paint was determined experimentally to have a viscosity of approximately 2000 centi-Poise (cP). With this medium, the drawn image tends to fade, being present for only a transient period of time. As another exemplary embodiment, water-based finger paint which has been diluted slightly with water to provide even lower viscosity can be used as the medium. For this example, drawn images fade quickly, leaving a slight residual "ghost" image where the image is originally drawn. A drawing apparatus constructed using a relatively low viscosity medium can be suitable as a children's toy. Drawings are easily made by using the fingers, requiring no greater dexterity than finger painting. Unlike finger paints, however, no mess is produced by the drawing apparatus, since the medium is completely contained within the chamber, and hence cannot be spilled from the drawing apparatus. Furthermore, because the drawing apparatus is self-contained, it can be used in many locations where traditional finger paints are undesirable due to the risk of mess, including for example in an automobile.

As another example, the medium can have a medium or high viscosity, in which case the drawing will tend to persist for a substantial period of time. For example, a drawing apparatus in accordance with the teachings of this disclosure has been constructed using finger paint as the viscous, sticky medium. Images drawn as just described persisted for periods of time in excess of several days. As another example, acrylic paint provides a particularly advantageous combination of viscosity and stickiness, having a viscosity of approximately 50,000 cP. Acrylic paint generally includes a pigment, water, and an acrylic emulsion. The pigment provides the coloring properties, and the acrylic emulsion acts as a binder providing viscosity and stickiness properties while the paint is wet. As the water evaporates from the paint, the viscosity increases. Primer paint may also provide a useful combination of viscosity and stickiness.

Finer detail can be captured by the drawing apparatus by using a thin layer of medium and even higher viscosity. For example, using a thin medium layer (e.g., 0.010 inch or less) and a viscosity of approximately 150,000 cP, finely detailed drawings can be made using a fingernail or stylus. Even higher viscosity, for example, approximately 250,000 cP, has also proven useful. Hence, viscosity in the range of 2,000 cP to 250,000 cP has proven useful in the drawing apparatus, although viscosity outside this range may also be useful.

Viscosity of the medium can be affected by temperature. Hence, for an application which will be subjected to extreme temperatures, it is preferable to select a medium having the desired viscosity properties over the expected operational temperature range. Various alternatives for existing and newly formulated medium suitable for use in embodiments of the present invention will occur to one of skill in the art having possession of this disclosure.

The thickness of the medium also affects the drawing properties. When the thickness of the medium is approximately 0.040 inch (1 mm), images can be drawn using fingers as described above. When the thickness of the medium is approximately 0.010 inch (0.25 mm) images can be drawn using a finger, fingernail or stylus. When the thickness of the medium is approximately 0.001 inch (25 micrometers), images can be drawn with a fingernail or stylus. Even thinner layers can be used, depending on the medium and desired opacity. In general, a thinner medium layer provides finer drawing resolution, but tends to be less opaque. Conversely, a thicker medium layer provides less distinct drawing features but tends to be more opaque. A thicker medium layer is also easier to erase, as will be described next. Accordingly, the thickness of the chamber and medium layer can be adjusted to provide the desired properties. Thickness in the range of 0.001 inch (25 micrometer) to 0.040 inch (1 mm) has proven experimentally useful, although thickness outside this range may also be useful. The color and quantity of pigment in the medium can also be adjusted.

The thickness of the flexible drawing surface also affects the drawing detail which can be obtained. A thin, highly flexible drawing surface enhances the fine level detail which can be drawn. Relatively thick drawing surfaces on the order of 0.004 inch (100 micrometer) to 0.02 inch (500 micrometer) are suitable for finger drawing. For fine detail drawing with a fingernail or stylus, a drawing surface thickness of 0.001 inch (25 micrometer) was found advantageous. One drawback of a very thin drawing surface is that it can be difficult to maintain a nonporous surface, which can lead to evaporation of the medium as discussed above. A very thin, porous, drawing surface can be augmented by a nonporous adjacent surface to help prevent evaporation, as discussed below. In general, drawing surface thickness of 0.0001 inch (2.5 micrometer) to 0.008 inch (200 micrometer) can prove useful for providing fine drawing resolution, although other thicknesses may also prove useful.

Images can also be erased by applying localized pressure to the flexible drawing surface. Moving several fingers, a soft eraser, a scraper, or a squeegee lightly across the flexible drawing surface migrates the sticky, viscous medium back into the drawing lines (areas where the medium has been displaced), separating the drawing surface from the rigid base. This allows the medium to relax, returning to an approximately uniform layer between the flexible drawing surface and rigid base. For more viscous medium, applied in thinner layers, a correspondingly greater erasing force is generally necessary to erase the drawing. For example, using a medium with an approximate viscosity of 150,000 cP, a medium layer of 0.0025 inch (64 micrometer) was suitable for erasing using fingers and a medium layer of 0.001 inch (25 micrometer) was suitable for erasing using a squeegee. An excessively viscous or thin medium may prove difficult to erase. Optionally, an erasing tool can be included with the drawing apparatus. The erasing tool can be configured to also function as a stand for the drawing apparatus.

Various ways of constructing the drawing apparatus will occur to one of skill in the art. For example, as illustrated in FIG. 4 in accordance with an embodiment of the present invention, a drawing apparatus 150 includes a frame 116 to which the rigid base surface is attached, for example, using sonic welding. The rigid base surface can be a firm material (e.g., hard plastic, such as acrylic) or a flexible material pulled taut in the frame (e.g., ethylene vinyl alcohol copolymer (EVOH) or polyethylene or a combination of these or similar materials). The materials from which the drawing apparatus is constructed can be non-toxic materials which enhance the suitability for use as a children's toy. Of course, many materials are suitable for constructing the drawing apparatus, including plastic, as discussed in further detail below.

Figure 5:
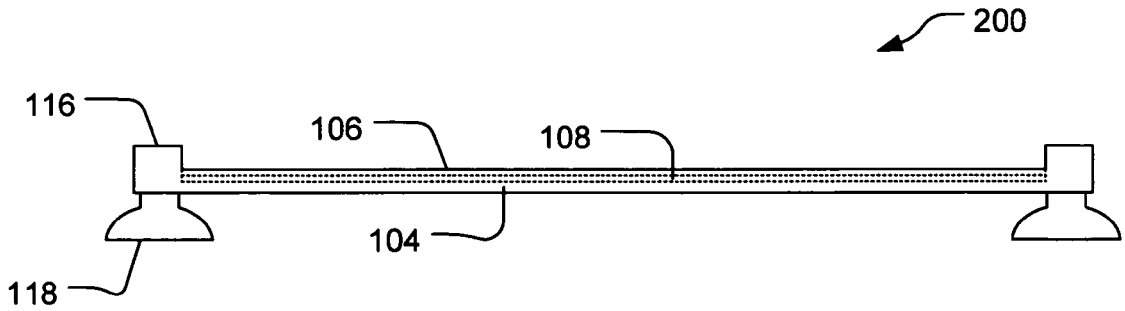
FIG. 5 is a side view of a drawing apparatus having mounting means in accordance with another embodiment of the present invention.

As illustrated in FIG. 5 in accordance with another embodiment of the present invention, a drawing apparatus 200 can optionally include means for mounting the drawing apparatus to a surface, for example a window. The mounting means can be provided, for example, by suction cups 118 or magnets (not shown). As another example, the drawing apparatus can include a hole (not shown) in the base or frame, for example, to allow the drawing apparatus to be hung by a string or pinned to a surface. Various other equivalent ways of mounting the drawing apparatus will occur to one of skill in the art.

The rigid base surface 104, viscous, sticky medium 108, and flexible drawing surface 106 can be selected to have optical properties and colors which enhance the color and contrast of the drawn image. For example, the rigid base can be clear and the medium a dark color, such as blue or purple. Or, the rigid base can be opaque white and the medium a bright (translucent or opaque) red. As another example, a translucent yellow base surface can be combined with a translucent blue medium. As light shines through the drawing apparatus, the drawing lines will be bright yellow (where the medium has been displaced and just the rigid base is seen) against a darker green background (from the combined yellow of the rigid base and blue of the medium), providing a neon light effect. The base, drawing surface, and medium can each be individually colored or clear. Different colors can be used on different portions of the base or drawing surface to provide interesting visual effects. Various colors, including white, black, fluorescent, phosphorescent (e.g. "glow in the dark"), reflective (e.g., mirrored) and metallic can be used. Hence, a virtually unlimited number of combinations can be constructed.

Figure 7:
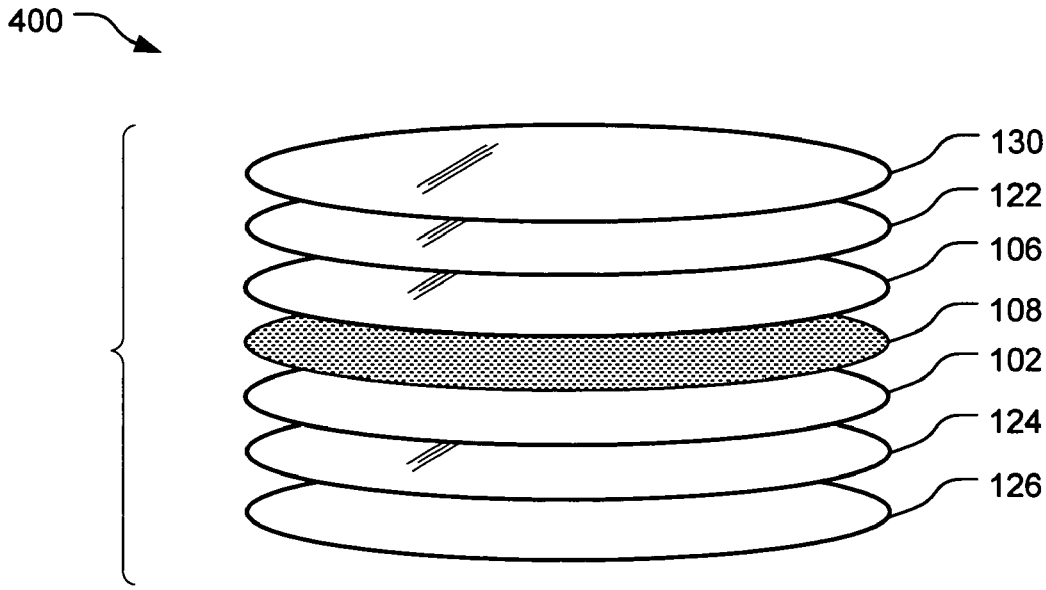
FIG. 7 is an exploded perspective view of a drawing apparatus having colored films and/or stencils in accordance with another embodiment of the present invention.

Alternately, the drawing apparatus can include colored films. For example, FIG. 7 illustrates an exploded diagram of a drawing apparatus 400 which can optionally include a colored film 122 placed adjacent to (either in front or behind) the flexible drawing surface 106 or a colored film 124 placed adjacent to (either in front or behind) the rigid base 102, or both. The colored films can be removable and interchangeable, and a variety of different colors provided, allowing different colors to be used with the drawing apparatus, enhancing the appeal of the drawing apparatus. Films with multiple colors can also be used, providing kaleidoscope effects. Although transparent films are desirable, opaque or translucent films can also be used. For example, holographic paper can provide a particularly striking effect.

The drawing apparatus can also include stencils. For example, as shown in FIG. 7 the drawing apparatus 400 can optionally include a drawing guide 130 placed in front of the flexible drawing surface or a silhouette stencil 126 placed behind the rigid base surface, or both. A drawing guide can be a drawing stencil, drawing on clear material for tracing, or similar. A silhouette stencil can be included to provide a fixed image which can be combined with the drawn image. Silhouette and drawing stencils can be removable and interchangeable. Alternately, reflective paper or film can be applied to the base, such as holographic paper. A stencil, colored film, or other insert can also be laminated into the base. Films, stencils, or other enhancements need not be arranged exactly as shown in FIG. 7, as many alternate useful arrangements will occur to one of skill in the art having possession of this disclosure.

Figure 6:
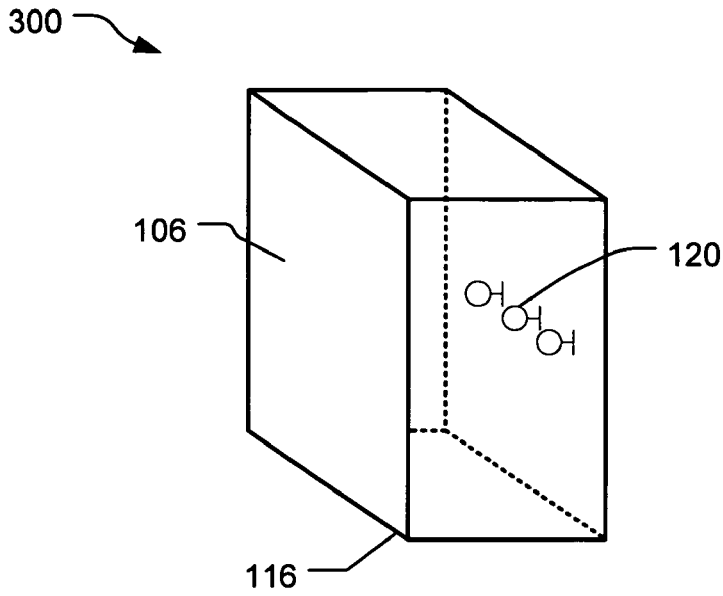
FIG. 6 is a perspective view of a drawing apparatus having a light source in accordance with another embodiment of the present invention.

Color and contrast of a drawn image can be enhanced by shining light through the drawing apparatus. For example, the drawing apparatus can be mounted to a window. Alternately, the drawing apparatus can include a light source. As another example, FIG. 6 illustrates a square-shaped drawing apparatus 300 having a light source 120 mounted within a frame 116 in accordance with an embodiment of the present invention. The flexible drawing surface 106 is mounted to the front of the frame, with the viscous, sticky medium (not shown) and rigid base surface (not shown) positioned as discussed above. Light from the light source passes through the rigid base, medium, and out through the drawing surface. The light source can be a single light emitting device or a plurality of devices. The light source can also be colored, or switchable between several different colors or combinations of colors. Alternately, the drawing apparatus can be constructed so the light passes through the drawing surface, medium, and out through the rigid base. Light passing through the apparatus can enhance the optical properties of the medium.

Figure 8:
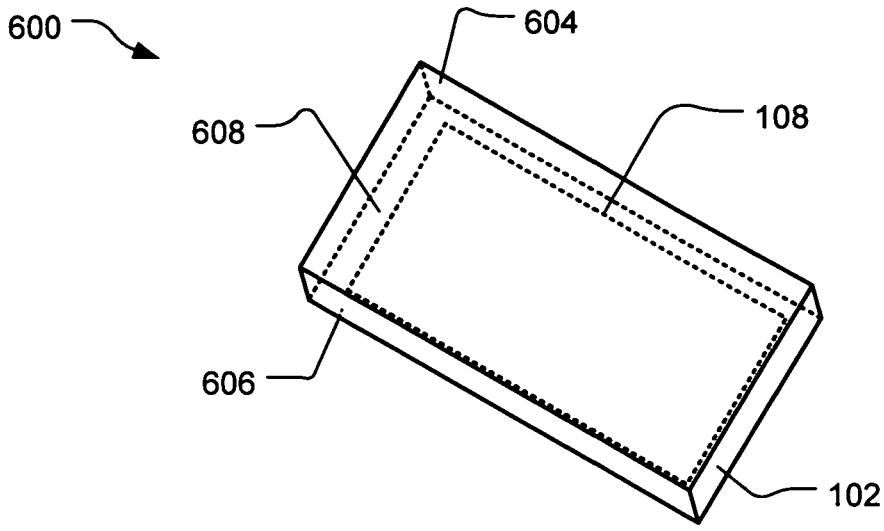
FIG. 8 is perspective view of a drawing apparatus in accordance with an alternate embodiment of the present invention.
Figure 9:
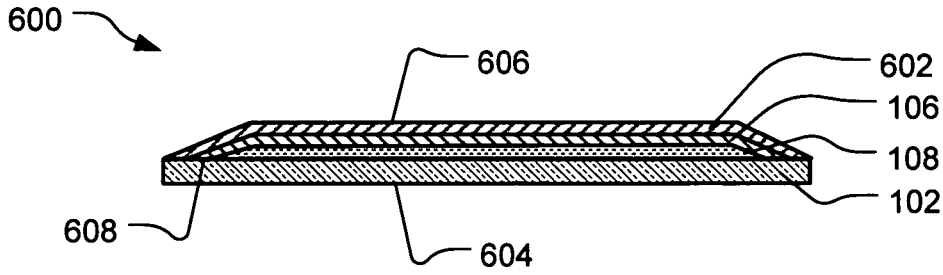
FIG. 9 is a cross-section view of the drawing apparatus of FIG. 8.

FIGS. 8 and 9 illustrate another drawing apparatus in accordance with an embodiment of the present invention. The drawing apparatus, shown generally at 600, includes a base 102, viscous, sticky medium 108, a flexible drawing surface 106, and a colored layer 602. In this arrangement, the base is a rigid, transparent material. The base provides a front side 604 through which the drawing is viewed, and drawing is performed on the back side 606. Although the drawing implement contacts the colored layer, the drawing elements are formed by the flexible drawing surface being placed into contact with the base as discussed above. This arrangement can provide additional excitement in a child's toy, since the drawing appears as if by magic. High quality drawing can be performed using this embodiment, making it suitable for use as a message board, sign, or name badge. This arrangement provides an additional advantage that scratches on the flexible drawing surfaces caused by repeated use or abuse are not visible when the drawing is viewed through the base. The front surface of the base can provide a clean, aesthetic appearance. Optionally, drawing in a conventional manner (e.g., using erasable markers) can also be performed on the front surface to provide additional visual effects. As discussed above, the base, flexible drawing surface, and medium can be selected to have a variety of optical properties and/or colors.

The base 102 can be made of acrylic, polycarbonate, or similar materials (e.g. Plexiglass® or Lexan®). It is desirable that the base material be nonporous to avoid evaporation from the medium which may cause it to become excessively viscous or permanently bonded to the base and/or flexible drawing surface. Note, however, that in some applications, in may be desirable to allow such evaporation, causing the drawing to be preserved in a permanent state. The base is sufficiently rigid over localized areas to allow drawing to be performed by displacing a portion of the drawing surface and medium as described above. In general, greater rigidity is desirable in the base when finer drawing detail is desired. For example, for finger drawing, a fairly elastic base has proven suitable (e.g., a membrane drawn taut in a frame). In contrast, for fine drawing with a stylus, a fairly rigid base (e.g., hard plastic such as acrylic) is preferable. Hence, semi-rigid or ductile materials (e.g. Polyethylene Terephthalate (PETE) or High Density Polyethylene (HDPE) as used for containers) can provide adequate rigidity for use in embodiments of the present invention. As another example, the base may be provided by a bendable or ductile piece of plastic, providing a generally curved surface. Many suitable materials for the base will occur to one of skill in the art having possession of this disclosure.

The flexible drawing surface 106 can be cellophane, polyvinyl chloride, or similar thin material. It is preferable that the flexible drawing surface is nonporous to avoid evaporation of from the medium as discussed above. For example, the flexible drawing surface can be constructed from EVOH or include a film of EVOH or similar material to provide a gas barrier. The flexible drawing surface is affixed to the base at a periphery 608, for example using glue or tape or other bonding techniques. In contrast to the base, the drawing surface is flexible over localized areas to allow portions of the drawing surface to be displaced as described above. Many suitable materials for the flexible drawing surface will occur to one of skill in the art having possession of this disclosure The colored layer 602 can be provided by various materials. For example, the colored layer can be a layer of paint applied directly on the flexible drawing surface 106. Alternately, the colored layer can be a layer of material laminated to the flexible drawing surface.

Alternately, the colored layer 602 can be separate from the flexible drawing surface 106. For example, the colored layer can be metalized polyester film (e.g. Mylar®) placed over the flexible drawing surface, and attached to the base 102 at the periphery 608, for example by gluing or taping or other bonding techniques. An air gap (e.g., a few 0.001 inch thick) can optionally be included between the colored layer and flexible drawing surface. As another example, the colored layer can be a sheet of cellophane or similar material which has been painted with a desired color using, for example, a plastic paint. Optionally, multiple layers of color can be used, for example, painting an inside of the colored layer with a bright fluorescent color that will be visible through the drawing elements, and painting an outside of the color layer with a neutral color to hide the fluorescent color. The stack up just described tends to enhance the visual impact of the drawing apparatus, since the fluorescent color is hidden from view until a drawing is made, providing mystery as to how the device operates. Various colors, including metalized films, bright fluorescent colors, and glow in the dark paint can be used, providing a striking effect not previously achievable.

Placing the colored layer 602 over, but not laminated to, the flexible drawing surface provides an improvement in the drawing resolution as compared to including colored materials directly (e.g. laminated) on the flexible drawing surface. This is because the flexible drawing surface is semi-permanently deformed and placed into contact with the inner surface of the base. The flexible drawing surface can be quite thin, (e.g., approximately 0.0001 inches) while the separate colored layer can be thicker (e.g., approximately 0.010 inches). The colored layer deforms during drawing, but can spring back since it is not laminated to the flexible drawing surface. The medium thus need only be sticky enough to hold the relatively thin flexible drawing surface in place, rather than the thicker colored layer. Optionally, the colored layer can also include one or more protective layers (e.g. Avery® self adhesive laminating sheet). For example, the colored layer can be a nonporous material to help avoid evaporation of the medium through a thin or porous drawing layer.

Various drawing apparatus have been shown in both a circular and square configuration. As will be understood by one of skill in the art, many other shapes are possible. For example, the drawing apparatus can be shaped as an animal or a corporate logo, or appropriate ornamental features included on the frame, base, or drawing surface. Furthermore, the drawing apparatus need not be limited to a two dimensional configuration as illustrated. The rigid base surface and drawing surface can be curved, bent, or formed in a three dimensional shape, for example a mask.

Figure 10:
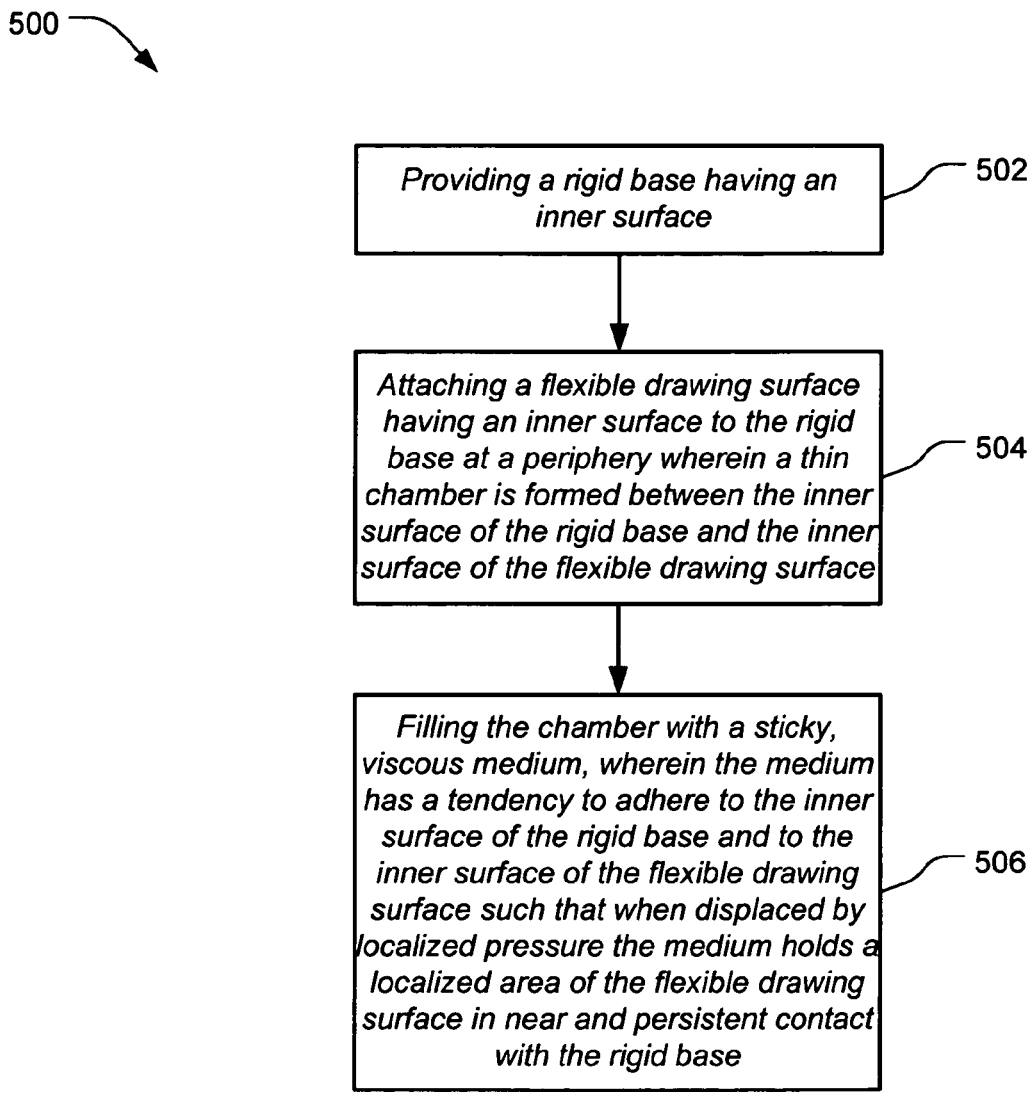
FIG. 10 is a flow diagram of a method for fabricating a drawing apparatus in accordance with an embodiment of the present invention.

Finally, a method 500 for fabricating a drawing apparatus is illustrated in flow chart form in FIG. 10 in accordance with an embodiment of the present invention. The method includes providing 502 a rigid base having an inner surface. Another step of the method includes attaching 504 a flexible drawing surface to the rigid base. The flexible drawing surface includes an inner surface, such that a chamber is formed between the inner surface of the rigid base and the inner surface of the flexible drawing surface. A next step of the method completes the formation of a drawing apparatus by filling 506 the chamber with a sticky, viscous medium which has a tendency to adhere to the inner surface of the rigid base and the inner surface of the flexible drawing surface such that when displaced by localized pressure the medium holds a localized area of the flexible drawing surface in near and persistent contact with the rigid base. For example, filling the chamber can be performed by injecting the medium into an orifice or opening into the chamber and sealing the orifice or opening after injection is complete. Optionally, the step of filling the chamber can be performed by placing a thin layer of the medium on the rigid base before attaching the flexible drawing surface. As yet another option, the step of filling the chamber can be performed by placing a thin layer of the medium on the flexible drawing surface before attaching the flexible drawing surface to the rigid base.

In filling the chamber with the viscous sticky medium, there can be a tendency for air bubbles to form in the medium. Various ways to remove air bubbles will occur to one of skill in the art, including, for example, forcing the air bubbles out through a vent hole that is then sealed. Alternately, air bubbles can be left as a visual enhancement. For example, air bubbles can contribute to a spacey effect, particularly when combined with a holographic paper or metalized polyester film backing, or when shining light through the drawing apparatus.

In accordance with another embodiment of the present invention, the method can also include forming an image by applying localized pressure to the flexible drawing surface. Localized pressure can be applied directly to the flexible drawing surface, or indirectly through a colored layer or film placed adjacent to the flexible drawing surface. The localized pressure displaces a portion of the sticky viscous medium to force a displaced portion of the flexible drawing surface into near contact with the rigid base. The medium holds the displaced portion of the flexible drawing surface in persistent contact with the rigid base.

In accordance with another embodiment of the present invention, the method can also include writing a message in the medium. For example, the drawing apparatus can be used as a display sign in a restaurant, where the message is the daily specials, and the drawing apparatus is displayed as a sign.

From the foregoing, and reiterating to some extent, it will be appreciated that a drawing apparatus in accordance with embodiments of the present invention provides several advantageous features. In one embodiment, the drawing apparatus is suitable for use as a child's toy. Being self contained, the drawing apparatus can be used virtually anywhere, avoids the risk of spillage or errant markings as with convention paints, pens, or markers. Drawings can be easily made using fingers or fingernails, and easily erased. Dulling of colors as can occur with mixed paints is avoided. Furthermore, boredom that may set in due to a limited color palette can be mitigated by using interchangeable color films or colored lights.

In another embodiment, the drawing apparatus is suitable for use as a message board, memo board, name badge, human billboard, or sign. For example, drawing can be in the form of finely detailed writing, using higher viscosity medium as discussed above and writing with a fingernail or stylus. Reuse of the drawing apparatus can be accomplished by erasing a previous drawing as described above. Thus, the drawing apparatus can provide a no-waste alternative to paper notes, such as the Post-It® note.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiments of the invention, it will be apparent to those of ordinary skill in the art that numerous modifications can be made without departing from the principles and concepts of the invention as set forth herein. Accordingly, it is not intended that the invention be limited, except as by the claims set forth below.

What is claimed is:

1. A drawing apparatus comprising:

a) a transparent base having a rigid base surface;

b) a flexible drawing surface attached to the base so as to form a thin chamber between the rigid base surface and the flexible drawing surface; and c) a viscous, sticky medium disposed within the thin chamber, wherein i) the medium retains a substantially uniform thickness independent of apparatus orientation, and ii) localized pressure applied to the flexible drawing surface displaces a portion of the medium to place a localized area of the flexible drawing surface in near and persistent contact with the rigid base thereby forming a drawing element.

2. The drawing apparatus of claim 1, wherein the base further comprises a frame to which the rigid base surface is attached, wherein the rigid base surface is an elastic material pulled taut within the frame.

3. The drawing apparatus of claim 1, wherein the viscous, sticky medium has a light-affecting characteristic selected from the group consisting of colored, opaque, translucent, reflective, fluorescent, and phosphorescent.

4. The drawing apparatus of claim 1, wherein the viscous, sticky medium has a sufficiently high viscosity so as to hold the drawing for a substantial period of time.

5. The drawing apparatus of claim 1, wherein the viscous, sticky medium has a sufficiently low viscosity so as to hold the drawing for a transient period of time.

6. The drawing apparatus of claim 1, wherein the viscous, sticky medium has a sufficiently high stickiness such that the drawing element maintains a distinct boundary.

7. The drawing apparatus of claim 1, wherein the viscous, sticky medium is chosen from the group of materials consisting of finger paint, acrylic paint, oil paint, and primer paint.

8. The drawing apparatus of claim 1, further comprising means for mounting the drawing apparatus to a surface.

9. The drawing apparatus of claim 1, further comprising a light source placed behind the rigid base surface so that light from the light source is transmitted through the apparatus wherein light transmission is enhanced through localized areas where the medium has been displaced to form drawing elements.

10. The drawing apparatus of claim 1, further comprising a layer placed adjacent to one of the flexible drawing surface and the rigid base surface, wherein the layer has an optical property chosen from the group consisting of colored, opaque, translucent, reflective, fluorescent, and phosphorescent.

11. The drawing apparatus of claim 1, wherein the rigid base surface is nonporous and at least one of either the flexible drawing surface or a layer placed adjacent to the flexible drawing surface is nonporous.

12. The drawing apparatus of claim 1, wherein the flexible drawing surface is opaque.

13. A reusable drawing apparatus comprising:

a) a transparent base having a rigid base surface;

b) a flexible drawing surface attached to the base so as to form a thin chamber between the rigid base surface and the flexible drawing surface;

c) a colored layer placed on, but not laminated to, the flexible drawing surface opposite the thin chamber; and d) a viscous, sticky medium disposed within the thin chamber, wherein the medium has viscosity such that the medium (i) retains a substantially uniform thickness independent of apparatus orientation, and ii) localized pressure applied to the flexible drawing surface displaces a portion of the medium to place a localized area of the flexible drawing surface in near and persistent contact with the rigid base thereby forming a drawing element.

14. The reusable drawing apparatus of claim 13, wherein the medium has a viscosity between 2,000 centi-Poise and 250,000 centi-Poise.

15. The reusable drawing apparatus of claim 13, wherein the medium has a thickness between 0.001 inch and 0.040 inch.

16. The reusable drawing apparatus of claim 13, wherein the flexible drawing surface has a thickness between 0.0001 inch and 0.020 inch.

17. A method for using a drawing apparatus comprising:

providing a drawing apparatus comprising a rigid base having an inner surface, a flexible drawing surface having an inner surface attached to the rigid base at a periphery wherein a thin chamber is formed between the inner surface of the rigid base and the inner surface of the flexible drawing surface and the chamber is filled with a sticky, viscous medium, wherein the medium has a tendency to adhere to the inner surface of the rigid base and to the inner surface of the flexible drawing surface such that when displaced by localized pressure the medium holds a localized area of the flexible drawing surface in near and persistent contact with the rigid base;

forming an image in the drawing apparatus by applying localized pressure to the flexible drawing surface so as to displace a portion of the sticky, viscous medium and force a displaced portion of the flexible drawing surface into near contact with the rigid base; and erasing the image by applying light, unlocalized pressure to the flexible drawing surface so as to migrate the sticky, viscous medium into an approximately uniform layer between the flexible drawing surface and the rigid base.

18. The method of claim 17 further comprising selecting the viscosity of the medium so that the medium tends to hold the flexible drawing surface in displaced position for a desired persistence time.

19. The method of claim 17 further comprising selecting the stickiness of the medium so that the medium tends to form distinct boundaries between displaced and undisplaced regions.

* * * * *

UNITED STATES PATENT AND TRADEMARK OFFICE

CERTIFICATE OF CORRECTION

PATENT NO. : 7,568,916 B1
APPLICATION NO. : 11/222931
DATED : August 4, 2009
INVENTOR(S) : Wilco R. Stuhmer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 923 days.

Signed and Sealed this

Seventh Day of September, 2010

David J. Kappos

David J. Kappos
*Director of the United States Patent and Trademark Office*